US006877678B2

(12) United States Patent
Xu et al.

(10) Patent No.: US 6,877,678 B2
(45) Date of Patent: Apr. 12, 2005

(54) FUEL INJECTOR FLOW DIRECTOR PLATE RETAINER

(75) Inventors: Wenbin Xu, Fussa (JP); Michael X. Schneider, Victor, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/351,681

(22) Filed: Jan. 27, 2003

(65) Prior Publication Data

US 2003/0150942 A1 Aug. 14, 2003

Related U.S. Application Data

(60) Provisional application No. 60/356,791, filed on Feb. 14, 2002.

(51) Int. Cl.[7] ..... F02M 61/00

(52) U.S. Cl. ..... 239/533.12; 239/585.1; 239/596; 239/533.2

(58) Field of Search ..... 239/585.1, 533.12, 239/596

(56) References Cited

U.S. PATENT DOCUMENTS

RE33,841 E 3/1992 Rush et al.
5,694,898 A * 12/1997 Pontoppidan et al. ..... 123/470
5,718,387 A 2/1998 Awarzamani et al.
5,823,444 A * 10/1998 Reiter et al. ..... 239/533.12
5,862,991 A 1/1999 Willke et al.
6,170,763 B1 1/2001 Fuchs et al.
6,173,914 B1 * 1/2001 Hopf et al. ..... 239/583
6,390,067 B1 * 5/2002 Haltiner et al. ..... 123/470
6,575,382 B1 6/2003 Fischer et al.

* cited by examiner

*Primary Examiner*—Dinh Q. Nguyen
(74) *Attorney, Agent, or Firm*—Patrick M. Griffin

(57) ABSTRACT

A fuel injector flow director plate assembly having a conventional flow director plate and a director plate retainer disposed in a recess in the fuel injector, the retainer having any of several novel structures for reducing buildup of fuel in the corner between the plate retainer and the recess wall and eliminating dripping of fuel. For example, the retainer may be provided with a long skirt having a small diameter; a shorter skirt; a spherical skirt; a skirt stepped axially; a skirt formed as an axial flange on a separate ring member which is installed outside the retainer itself, the flange protruding through the retainer; a separate ring member installed outside a retainer and having an opening of diameter smaller than the opening in the retainer; and a separate ring member installed inside the retainer and having an opening of diameter smaller than the opening in the retainer.

11 Claims, 4 Drawing Sheets

FUEL INJECTOR FLOW DIRECTOR PLATE RETAINER

RELATIONSHIP TO OTHER APPLICATIONS

The present application claims priority from U.S. Provisional Patent Application Ser. No. 60/356,791, filed Feb. 14, 2002.

TECHNICAL FIELD

The present invention relates to a fuel injector for an internal combustion engine; more particularly to a fuel injector flow director plate sub-assembly having a plate member and a plate retainer; and most particularly to an improved flow director plate retainer for reducing the accumulation of injected fuel on the underside of the retainer and eliminating dripping of fuel therefrom.

BACKGROUND OF THE INVENTION

Electromagnetic fuel injectors used in internal combustion engines control the discharge of precisely metered quantities of fuel to the engine combustion chambers. Proper control of the shape of fuel discharge results in low exhaust emissions, high fuel economy, and improved driveability performance.

A typical electromagnetic fuel injector includes a solenoid assembly disposed in a generally cylindrical shell defined by a longitudinal axis having a fuel inlet at an upstream end and a nozzle at a downstream end. A reciprocally moveable valve assembly, mounted for linear movement along the longitudinal axis, has a valve end which is adapted to be moved from a seated and fuel sealing position with a cooperating valve seat and seat orifice therethrough, to an open position to define a fuel flow passage through the nozzle. The valve assembly is controlled in its movement by the electromagnetic force of the solenoid assembly, as is known in the art.

A flow director plate sub-assembly, positioned immediately downstream of the valve seat and seat orifice and supported in a fixed position adjacent the nozzle, typically comprises a plate member and a cup-shaped director plate retainer. The plate member has one or more orifices, located at predetermined angles and orientations relative to the longitudinal axis of the solenoid assembly, for targeting and controlling the spray pattern of fuel metered by the valve seat. The plate member typically also includes a circumferential flange. The plate member is held in proper position by the cup shaped director plate retainer which is pressed into a cylindrical recess at the injection end of the injector. The circumferential flange of the plate member cooperates with a nozzle shoulder to position the plate member coaxially with the valve seat.

In the prior art, the relatively large depth of the recess and the relatively large diameter of the recess at the injector tip in comparison to the diameter of the valve seat orifice are desirable for hot fuel handling and for minimizing plugging of the flow director orifice. Unfortunately, the large diameter and depth of the recess downstream of the valve seat also permit metered fuel to accumulate in the recess and to be released toward the combustion chamber during the next injector actuation as a non-controlled and non-atomized droplet. This is undesirable because such a droplet can fail to vaporize completely and cause an over-enrichment of delivered fuel, thereby causing an increase in engine hydrocarbon emissions, unstable engine speed and a reduction in fuel efficiency.

Therefore, what is needed in the art is a means for reducing the accumulation of a fuel drip downstream of the valve seat and a means for eliminating fuel dripping.

SUMMARY OF THE INVENTION

Briefly described, a fuel injector flow director plate assembly in accordance with the invention includes a conventional flow director plate for dispersing fuel injected from the nozzle tip of a fuel injector. The flow director plate is seated in a recess in the fuel injector and is retained therein by a director plate retainer. The retainer is formed to include any of several novel means for preventing flow of fuel along the surface of the plate retainer and buildup of fuel in the corner between the plate retainer and the recess wall. In a first embodiment, the retainer is provided with a long skirt having a small diameter within the recess. In a second embodiment, the skirt is shortened. In a third embodiment, the skirt is a spherical section. In a fourth embodiment, the skirt is stepped axially. In a fifth embodiment, the skirt is formed as an axial flange on a separate ring member which is installed outside the retainer itself, the flange protruding through the retainer. In a sixth embodiment, a separate ring member is installed outside the retainer itself and has an opening of diameter smaller than the opening in the retainer. In a seventh embodiment, a separate ring member is installed inside the retainer itself and has an opening of diameter smaller than the opening in the retainer.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
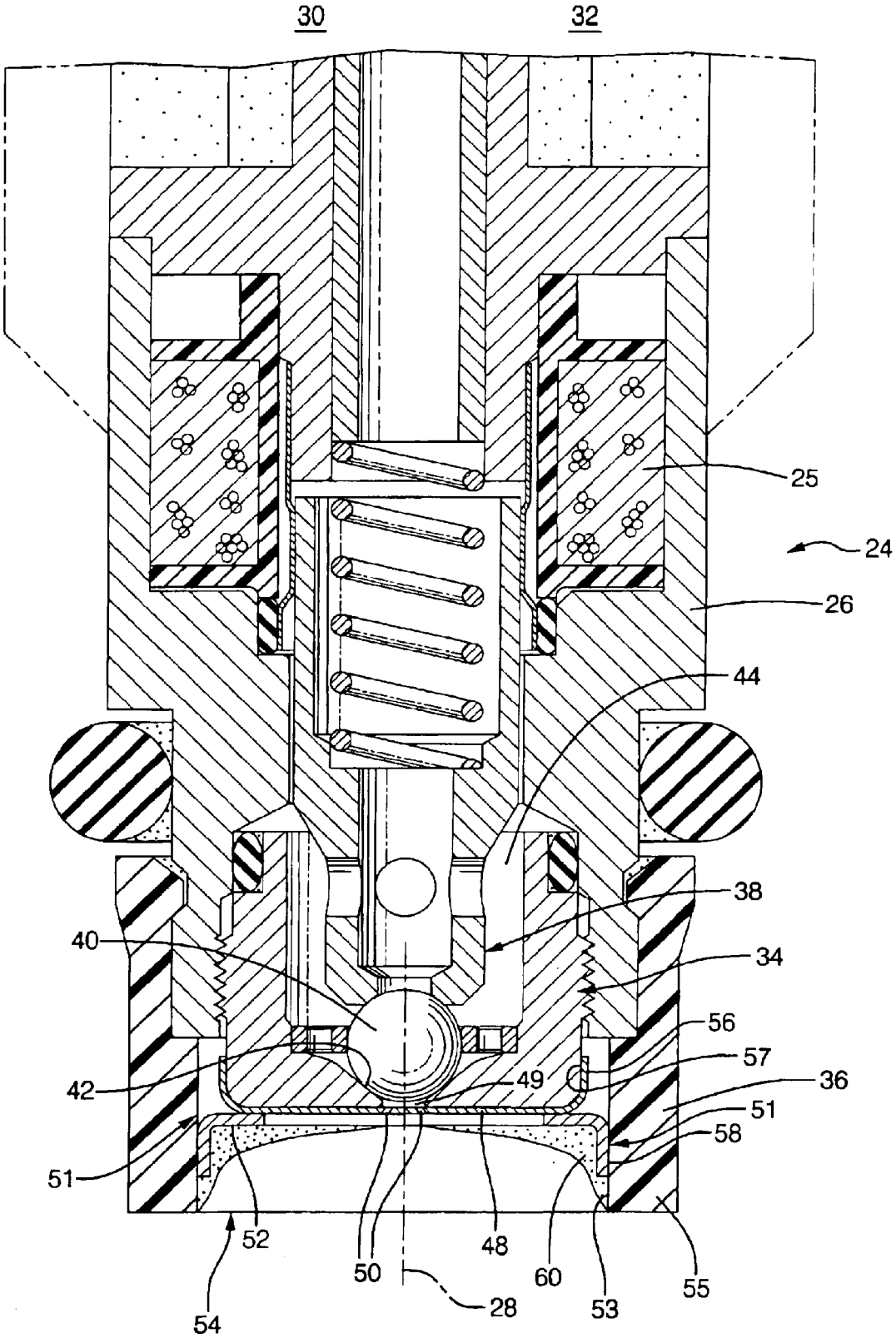
FIG. 1 is a cross-sectional view of a portion of a prior art fuel injector, showing a prior art director plate and plate retainer.

Referring to FIG. 1, there is illustrated a fuel injector 24 having a solenoid assembly 25 disposed within a generally cylindrical body 26 defined by a longitudinal axis 28 and having a fuel inlet, schematically shown as 30, at an upstream end 32 and a nozzle 34 at a downstream end 36. A reciprocally moveable valve assembly 38, mounted for linear movement along the longitudinal axis, has a valve end 40 which is adapted to be moved from a seated and fuel sealing position with a cooperating valve seat 42 and seat orifice 49 therethrough, to an open position to define a fuel flow passage 44 through the nozzle. The valve assembly is controlled in its movement by the electromagnetic force of the solenoid assembly, as is known in the art. While valve end 40 is depicted as a ball in FIG. 1, it is understood that the valve end can be of any shape suitable for its purpose as is known in the art.

A flow director plate sub-assembly 51, positioned downstream of the valve seat and supported in a fixed position below the nozzle, typically comprises a director plate member 48 and a cup shaped director plate retainer 52. The plate member includes one or more orifices 50 located at predetermined angles and orientations, relative to the longitudinal axis of the solenoid assembly, for targeting and controlling the spray pattern of the fuel metered by the valve seat. Plate member 48 is held in axial position by the cup shaped director plate retainer 52 as pressed into a cylindrical recess 54 at the tip end 55 of the injector wherein plate retainer flange 58 engages wall 53 of recess 54. Circumferential flange 56 of plate member 48 cooperates with nozzle shoulder 57 to position the plate member coaxially with valve seat 42.

Figure 2A:
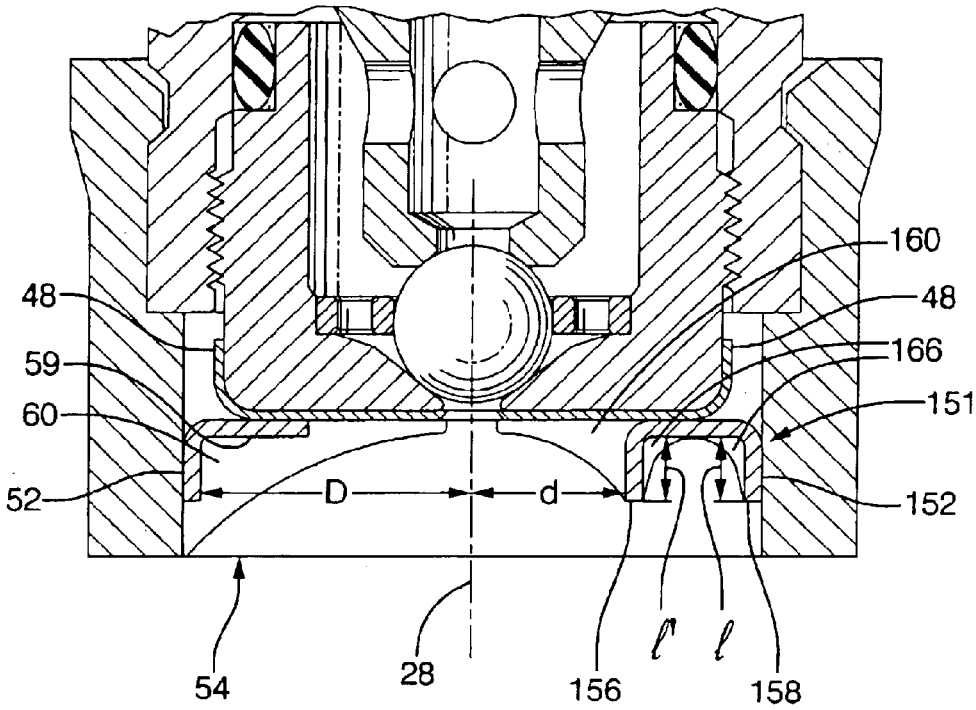
FIG. 2*a* is a split cross-sectional view of a tip of a fuel injector showing a prior art director plate retainer (left side, as in FIG. 1) and a first embodiment of a director plate retainer (right side) in accordance with the present invention.
Figure 2B:
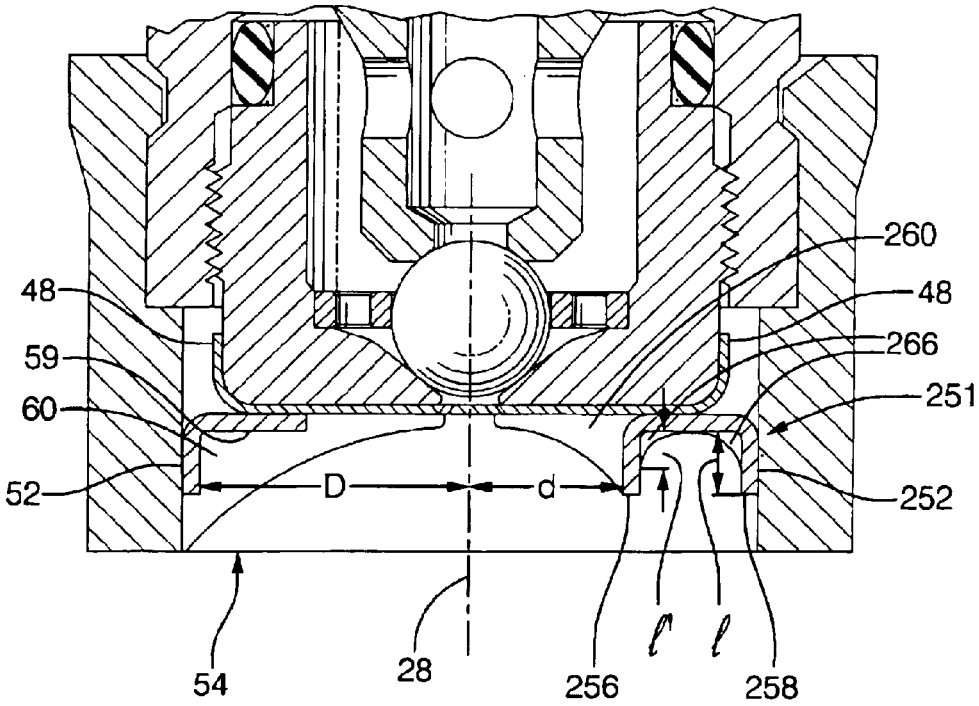
FIG. 2*b* is a split cross-sectional view, like that of FIG. 2*a,* showing a second embodiment of a director plate retainer.

FIGS. 2*a* and 2*b* depict the nozzle end of the injector assembly and illustrate the advantages of the present invention. In each drawing, the sides to the left of longitudinal axis 28 show plate member 48 and prior art director plate retainer 52 as in FIG. 1. Surface tension of the fuel causes a relatively large volume of fuel 60 to creep along the underside 59 of plate retainer 52 and to accumulate within recess 54, and to be discharged subsequently toward the combustion chamber in the form of a large uncontrolled and un-atomized drip.

In FIGS. 2*a* and 2*b,* the sides to the right of longitudinal axis 28 show two different embodiments of a director plate sub-assembly 151,251 in accordance with the invention. In these embodiments, director plate member 48 is identical in shape to director plate member 48 shown on the sides to the left of longitudinal axis 28 and in FIG. 1. However, improved director plate retainer 152 (first embodiment, FIG. 2*a*) includes a cylindrical inner skirt or flange 156 having an internal diameter (d). Flange 156 is substantially parallel to director plate outer flange 158, and flanges 156,158 are of about equal longitudinal length l',l. As can be seen in FIG. 2*a,* since the diameter (d) of fuel volume 160, measured from longitudinal axis 28, is less than the diameter (D) of fuel volume 60, and the volume of fuel in volume 160 and 166 combined is less than the volume of fuel in volume 60, the volume of fuel that accumulates in the recess 54 below the valve seat is substantially reduced.

The director plate sub-assembly second embodiment 251 shown in FIG. 2*b* offers an even greater reduction in the volume of fuel that accumulates below the valve seat. Director plate retainer 252 includes inner flange 256 that is substantially parallel with outer flange 258. However, while the longitudinal length of outer flange 258 is selected to optimize the press-fitability of the director plate retainer into recess 54, the longitudinal length of inner flange 256 is selected to be less than the length of the outer flange. Thus, since both the diameter and length of fuel volume 260 are less than the diameter and length of fuel volume 60, and the volume of fuel in volume 260 and 266 combined is substantially less than the volume of fuel in volume 60, the volume of fuel that accumulates below the valve seat and that can be discharged toward the combustion chamber in the form of an uncontrolled and un-atomized drip is reduced even further over embodiment 151. Moreover, since the volume of fuel that can collect in either 160 or 166 (FIG. 2*a*) or in either 260 or 266 (FIG. 2*b*) is substantially reduced, and inner flanges 156 and 256 serve to increase the surface contact with the fuel, the surface tension of the fuel is sufficient to prevent uncontrolled dripping of fuel from these areas.

Figure 2C:
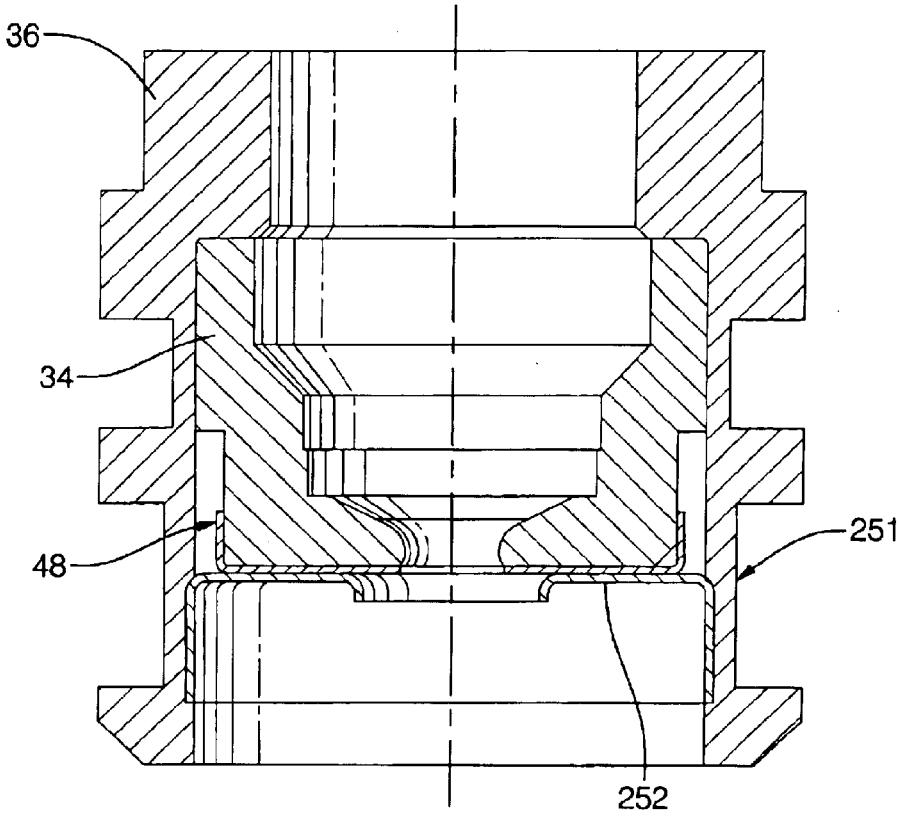
FIG. 2*c* is a cross-sectional view of a tip of a fuel injector showing an improved director plate retainer installed in the fuel injector.

FIG. 2*c* depicts the nozzle end of the injector assembly with plate member 48 and plate retainer 252 assembled into place.

Figure 3:
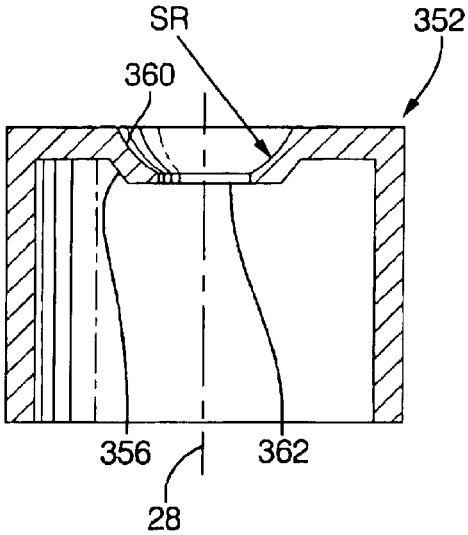
FIGS. 3 and 4 are cross-sectional views of third and fourth embodiments of director plate retainers, formed as single elements.

FIG. 3 shows a director plate retainer 352 of a third embodiment having an inner flange 356 formed by spherical segment 360 which is convex away from the director plate and has orifice 362 positioned co-axially with centerline 28.

Figure 4:
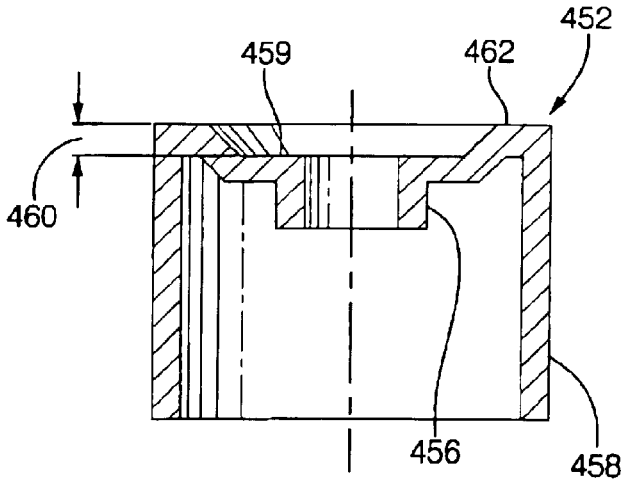

FIG. 4 shows a director plate retainer 452 of a fourth embodiment having inner flange 456 substantially parallel with outer flange 458, including a bottom surface portion 459 stepped axially from bottom wall 462 of retainer 452 by a distance 460.

Figure 5:
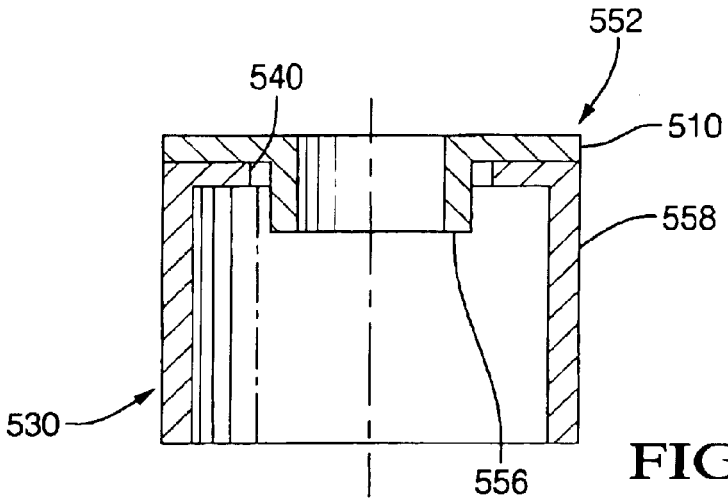
FIGS. 5, 6, and 7 are cross-sectional views of fifth, sixth, and seventh embodiments of director plate retainers, formed as two separate elements.
Figure 6:
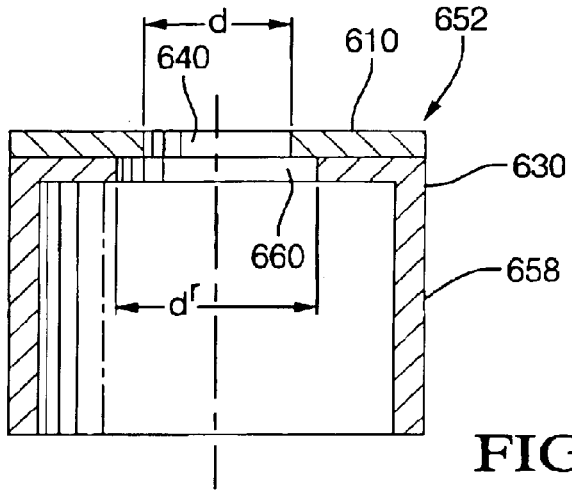
Figure 7:
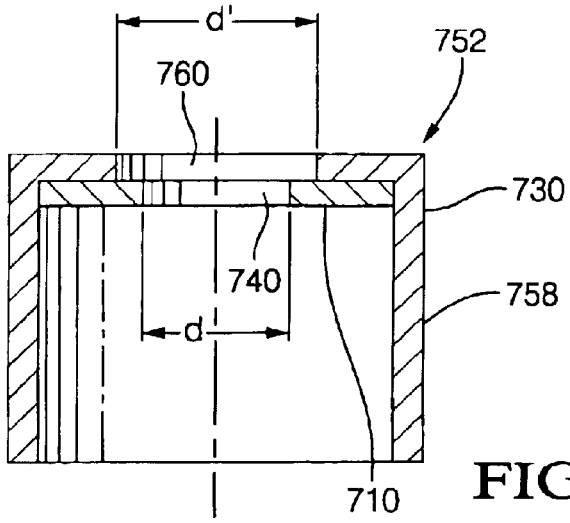

FIGS. 5 through 7 show fifth, sixth, and seventh embodiments, respectively, wherein director plate retainer assemblies 552, 652, and 752 are of two-piece construction, including retainer and ring members.

In embodiment 552, ring member 510 having axial opening 520 includes inner flange 556 substantially parallel to outer flange 558 of retainer member 530. Ring member 510 is disposed outside of retainer member 530, and flange 556 protrudes through an opening 540 in member 530.

In retainer assembly 652, ring member 610 is positioned on the outer bottom surface of retainer member 630 and includes a ring member opening 640 coaxial with an opening 660 and an outer flange 658 in retainer member 630. Diameter (d) of opening 640 is less than diameter (d') of opening 660.

In retainer assembly 752, ring member 710 is positioned on the inner bottom surface of retainer member 730 and includes a first opening 740 coaxial with a second opening 760 in retainer member 730, and outer flange 758. Diameter (d) of opening 740 is less than diameter (d') of opening 760.

While the embodiments shown in FIGS. 6 and 7 depict d' to be larger than d, it is contemplated that in either embodiment, d could be larger than d'.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A retainer for retaining a director plate in a recess in a fuel injector nozzle, comprising:

a) a first portion including an outer flange for engaging a wall of said recess, said outer flange having an axial length and an inner diameter;

b) a second portion including an inner flange, said inner flange having an inner diameter smaller than said inner diameter of said outer flange; and c) an underside portion positioned between said first and second portions, wherein said inner flange extends from said underside portion and away from said nozzle.

2. A retainer in accordance with claim 1 wherein said inner flange has an axial length equal to said outer flange axial length.

3. A retainer in accordance with claim 1 wherein said inner flange has an axial length less than said outer flange axial length.

4. A retainer in accordance with claim 1 wherein said inner flange includes a spherical segment.

5. A retainer in accordance with claim 1 wherein a bottom surface portion is stepped axially from a bottom wall.

6. A retainer in accordance with claim 1 wherein said second portion is formed separate from said first portion and said inner flange on said second portion protrudes through an opening in said first portion.

7. A retainer for retaining a director plate in a recess in a fuel injector nozzle, comprising:

a) a first portion including an outer flange for engaging a wall of said recess and a first axial opening having a first diameter; and b) a second portion disposed adjacent said first portion and having a second axial opening concentric with said first axial opening, said second opening having a second diameter, said second portion having an underside portion and an inner flange, wherein said inner flange extends from said underside portion and away from said nozzle.

8. A retainer in accordance with claim 7 wherein said first portion and said second portion are separate components.

9. A retainer in accordance with claim 7 wherein said first diameter is greater than said second diameter.

10. A retainer in accordance with claim 7 wherein said first diameter is less than said second diameter.

11. A fuel injector assembly comprising:

a) a body defined by a longitudinal axis having a fuel inlet at an upstream end and a nozzle at a downstream end;

b) a valve seat proximate said nozzle, said valve seat having a seat orifice;

c) a valve assembly having a valve end adapted for cooperative movement with said valve seat to define a fuel flow passage through said nozzle;

d) a tip end downstream of said nozzle having a recess;

e) a director plate disposed in said recess; and e) a retainer for retaining said director plate in said recess, said retainer having a first portion including an outer flange for engaging a wall of said recess, said outer flange having an inner diameter, a second portion including an inner flange, said inner flange having an inner diameter smaller than inner diameter of said outer flange, and an underside portion positioned between said first and second portions, wherein said inner flange extends from said underside portion and away from said nozzle.

* * * * *

UNITED STATES PATENT AND TRADEMARK OFFICE

CERTIFICATE OF CORRECTION

PATENT NO. : 6,877,678 B2
DATED : April 12, 2005
INVENTOR(S) : Wenbin Xu and Michael Schneider It is certified that error appears in the above-identified patent and that said Letters Patent is hereby corrected as shown below:

Title page,
Item [75], Inventors, "Michael X. Schneider" should read -- Michael Schneider --.

Signed and Sealed this

Thirtieth Day of May, 2006

JON W. DUDAS
*Director of the United States Patent and Trademark Office*